US009359710B2

(12) United States Patent
Lee et al.

(10) Patent No.: US 9,359,710 B2
(45) Date of Patent: Jun. 7, 2016

(54) LAUNDRY TREATING APPARATUS

(71) Applicant: LG ELECTRONICS INC., Seoul (KR)

(72) Inventors: Jungwan Lee, Seoul (KR); Junghoon Lee, Seoul (KR); Sogkie Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 62 days.

(21) Appl. No.: 14/257,638

(22) Filed: Apr. 21, 2014

(65) Prior Publication Data

US 2014/0317948 A1 Oct. 30, 2014

(30) Foreign Application Priority Data

Apr. 25, 2013 (KR) ..... 10-2013-0045888

(51) Int. Cl.

| | |
|---|---|
| ***D06F 58/20*** | (2006.01) |
| ***D06F 58/10*** | (2006.01) |
| ***D06F 58/12*** | (2006.01) |
| *D06F 73/02* | (2006.01) |

(52) U.S. Cl.

CPC ..... *D06F 58/10* (2013.01); *D06F 58/12* (2013.01); *D06F 58/203* (2013.01); *D06F 58/206* (2013.01); *D06F 73/02* (2013.01)

(58) Field of Classification Search

CPC ..... F26B 9/00; F26B 11/00; F26B 21/00; F26B 21/06; D06F 58/00; D06F 58/10; D06F 58/12; D06F 58/20

USPC ..... 34/595, 601, 606, 610; 68/5 C, 5 R, 19, 68/20; 8/139, 149, 159

See application file for complete search history.

(56) References Cited

U.S. PATENT DOCUMENTS 3,114,919 A * 12/1963 Kenreich ..... D06F 18/00 68/12.15
3,739,496 A * 6/1973 Buckley ..... D06F 73/02 312/271

(Continued)

FOREIGN PATENT DOCUMENTS

CN 102131979 A 7/2011
CN 103027558 A 4/2013

(Continued)

OTHER PUBLICATIONS

Great Britain Office Action dated Aug. 20, 2014 issued in Application No. GB1407302.7.

(Continued)

*Primary Examiner* — Stephen M Gravini
(74) *Attorney, Agent, or Firm* — KED & Associates, LLP

(57) ABSTRACT

A laundry treating apparatus is disclosed. The laundry treating apparatus includes a cabinet forming an external appearance of the laundry treating apparatus, a laundry accommodation portion arranged in the cabinet and providing a space to accommodate laundry, a machine chamber including at least one of an air supply unit to supply air to the laundry accommodation portion and a moisture supply unit to supply moisture to the laundry accommodation portion, the machine chamber being provided separately from the laundry accommodation portion, a laundry supporter to support a hanger having laundry placed thereon and to move the hanger such that a free end of the hanger forms an arc trajectory in the laundry accommodation portion.

16 Claims, 8 Drawing Sheets

(56) References Cited

U.S. PATENT DOCUMENTS

| | | | | |
|---|---|---|---|---|
| 4,211,121 | A * | 7/1980 | Brown | B06B 1/162 366/116 |
| 7,097,051 | B2 * | 8/2006 | Schober | A47B 61/003 211/100 |
| 7,103,996 | B2 * | 9/2006 | Hapke | D06F 73/02 38/1 A |
| 7,137,211 | B2 * | 11/2006 | Johnson | D06F 73/02 34/164 |
| 8,296,967 | B2 * | 10/2012 | Kim | D06F 58/12 34/164 |
| 8,327,558 | B2 * | 12/2012 | Hu | D06F 58/14 34/210 |
| 8,539,694 | B2 * | 9/2013 | Moon | D06F 58/10 34/606 |
| 8,621,763 | B2 * | 1/2014 | Park | D06F 58/12 34/202 |
| 8,695,228 | B2 * | 4/2014 | Lee | D06F 58/20 34/595 |
| 8,707,591 | B2 * | 4/2014 | Moon | D06F 58/10 223/85 |
| 8,925,216 | B2 * | 1/2015 | Lutz | D06F 57/12 211/100 |
| 8,997,372 | B2 * | 4/2015 | Cennon | D06F 58/20 34/201 |
| 9,074,313 | B2 * | 7/2015 | Kim | D06F 58/10 |
| 2007/0034280 | A1 * | 2/2007 | Contreras | B65B 51/08 140/149 |
| 2008/0185353 | A1 * | 8/2008 | Immerman | A47K 10/04 211/16 |
| 2010/0043247 | A1 | 2/2010 | Park et al. | 34/218 |
| 2010/0083531 | A1 * | 4/2010 | Hu | D06F 58/14 34/565 |
| 2013/0086830 | A1 | 4/2013 | Moon et al. | 38/1 A |
| 2014/0317948 | A1 * | 10/2014 | Lee | D06F 58/10 34/218 |

FOREIGN PATENT DOCUMENTS

| | | | | |
|---|---|---|---|---|
| EP | WO 2010/082759 | A3 | 7/2010 | |
| EP | 2 385 168 | A2 | 11/2011 | |
| EP | 2 423 377 | A1 | 2/2012 | |
| JP | H06-339598 | A | 12/1994 | |
| JP | 2006-130157 | A | 5/2006 | |
| JP | 5486063 | B2 * | 5/2014 | D06F 58/10 |
| KR | 10-2011-0137467 | A | 12/2011 | |
| KR | 10-2012-0078279 | A | 7/2012 | |
| KR | DE 202012009608 | U1 * | 1/2013 | D06F 58/10 |
| KR | 20130038659 | A * | 4/2013 | D06F 58/10 |
| KR | EP 2581487 | A1 * | 4/2013 | D06F 58/10 |
| KR | EP 2581487 | B1 * | 12/2014 | D06F 58/10 |
| WO | WO 2010/082759 | A2 | 7/2010 | |

OTHER PUBLICATIONS

Chinese Office Action dated Oct. 10, 2015 issued in Application No. 201410171019.2 (with English translation).

* cited by examiner (a)

(b)

(a)

(b)

LAUNDRY TREATING APPARATUS

This application claims the priority of the Korean Patent Application No. 10-2013-0045888, filed on Apr. 25, 2013 which is hereby incorporated by reference as if fully set forth herein.

BACKGROUND OF THE INVENTION

1. Field of the Invention

The present invention relates to a laundry treating apparatus.

2. Discussion of the Related Art

A laundry treating apparatus is a device that generally performs various operations (washing, drying, deodorization, wrinkle removal) related to laundry. The laundry treating apparatus includes a washing machine to wash laundry, a drying apparatus to dry wet laundry, and a refresher to remove odor and wrinkles from the laundry.

Recently, a laundry treating apparatus capable of performing all such operations as washing, drying, deodorization and wrinkle removal has been developed.

However, such laundry treating apparatus employs a drum to accommodate laundry and a drive unit to rotate the drum, and may not properly perform deodorization of laundry and removing wrinkles from the laundry.

That is, the conventional laundry treating apparatus generally performs deodorization or wrinkle removing operation during rotation of the drum. However, the laundry introduced into the drum is in a folded state rather than in a stretched-out state, and thus removing wrinkles or deodorizing the laundry may be limited.

SUMMARY OF THE INVENTION

Accordingly, the present invention is directed to a laundry treating apparatus that substantially obviates one or more problems due to limitations and disadvantages of the related art.

An object of the present invention is to provide a laundry treating apparatus that may facilitate drying, deodorization, wrinkle removal and sanitization of laundry.

Another object of the present invention is to provide a laundry treating apparatus that may prevent damage to the laundry and reduce power consumption.

A further object of the present invention is to provide a laundry treating apparatus provided with an accommodation space to accommodate laundry items of different lengths.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus includes a cabinet forming an external appearance of the laundry treating apparatus, a laundry accommodation portion arranged in the cabinet and providing a space to accommodate laundry, a machine chamber including at least one of a air supply unit to supply air to the laundry accommodation portion and a moisture supply unit to supply moisture to the laundry accommodation portion, the machine chamber being provided separately from the laundry accommodation portion, a laundry supporter to support a hanger having laundry placed thereon and to move the hanger such that a free end of the hanger forms an arc trajectory in the laundry accommodation portion.

The laundry supporter may include an adapter allowing the hanger to be detachably mounted thereto, a support part positioned in the laundry accommodation portion to support the adapter, and a drive unit to move the adapter such that the adapter reciprocates within a predetermined angular range while and forms an arc trajectory.

The support part may include a housing having an accommodation space therein, a housing support bar connecting the housing to the laundry supporter, and an adapter insertion hole allowing the accommodation space to communicate with an exterior of the housing and allowing the adapter to be inserted thereinto, the drive unit may include a driving bar configured to reciprocating within the accommodation space and connected to end of the adapter, and the adapter may include an accommodation groove positioned over the adapter insertion hole and allowing a hook provided to the hanger to be detachably accommodated therein.

The support part may further include an adapter support surface inclined from a surface of the housing toward the adapter insertion hole to support a surface of the adapter.

The support part may further include an inclined surface inclined from a surface of the accommodation space toward the adapter insertion hole to limit a range of reciprocation of the adapter.

The drive unit may further include a driving bar supporter rotatably provided in the accommodation space to support the driving bar.

The driving bar may include a driving bar body formed in a bar shape to reciprocate in the accommodation space, and a lower guider arranged in a longitudinal direction of the driving bar body and provided to opposite ends of a lower surface of the driving bar body facing each other, wherein the driving bar supporter may include a lower roller positioned in a space formed by the lower guider and contacting the driving bar body.

The driving bar may include an upper guider arranged in the longitudinal direction of the driving bar body and provided to opposite ends of an upper surface of the driving bar body facing each other, wherein the driving bar supporter may include an upper roller positioned in a space formed by the upper guider and contacting the driving bar body.

The drive unit may further include a power supply unit to provide power causing the driving bar to reciprocate in the accommodation space.

The power supply unit may include a motor provided with a rotation shaft and fixed to an exterior of the laundry accommodation portion and a power conversion unit to convert rotation of the rotation shaft into rectilinear reciprocation, wherein the support part further may include a connection bar through hole penetrating the housing to allow the accommodation space to communicate with the exterior of the housing, and the drive unit further may include a connection bar connecting the power conversion unit to the driving bar through the connection bar through hole.

A length of the connection bar through hole formed in a longitudinal direction of the housing may be greater than a width of the connection bar formed in a longitudinal direction of the driving bar.

The power conversion unit may include a slot housing positioned in the laundry accommodation portion and arranged in a plane parallel with a plane having the accommodation space positioned, the connection bar being fixed to the slot housing, a slot provided to the slot housing, a rotating arm rotated by the motor, and a slot insertion portion extending from the rotating arm and inserted into the slot, wherein a length of the slot is greater than or equal to a diameter of an rotation trajectory formed by the slot insertion portion.

The power supply unit may further include a power transmission unit to transfer rotary power of the rotation shaft to the rotating arm, wherein the power transmission unit may include a transmission shaft arranged to penetrate the laundry accommodation portion, a driven pulley provided to the transmission shaft, a drive pulley provided to the rotation shaft, and a belt to connect the drive pulley to the driven pulley, and the power conversion unit further may include a shaft coupling portion to connect the transmission shaft to the rotating art.

The machine chamber may be provided with a width smaller than a width of the laundry accommodation portion such that the space to accommodate the laundry placed on the laundry supporter is formed between an outer surface of the machine chamber and an inner surface of the laundry accommodation portion.

The laundry treating apparatus may further include an auxiliary accommodation portion provided in the space between the outer surface of the machine chamber and the inner surface of the laundry accommodation portion to provide a storage space, wherein a height of the auxiliary accommodation portion may be lower than a height of the machine chamber.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Embodiments of the configuration and control method of an apparatus described below are merely illustrating and are not intended to limit the scope of the present invention. Wherever possible, the same reference numbers will be used throughout the drawings to refer to the same or like parts.

Examples of a laundry treating apparatus according to embodiments of the present invention may include a refresher to refresh the laundry and an apparatus to dry and deodorize the laundry and to remove wrinkles from the laundry.

Herein, refreshing represents an operation of providing at least one of air and moisture to the laundry to remove wrinkles from the laundry, to deodorize and sanitize the laundry, to prevent static electricity, and to dry the laundry.

In addition, the term laundry mentioned in this specification includes not only clothes and apparel, but also wearable objects such as shoes, socks, hats and scarves and objects usable by people such as dolls, towels and bedding. Laundry also includes all washable objects.

Figure 1:
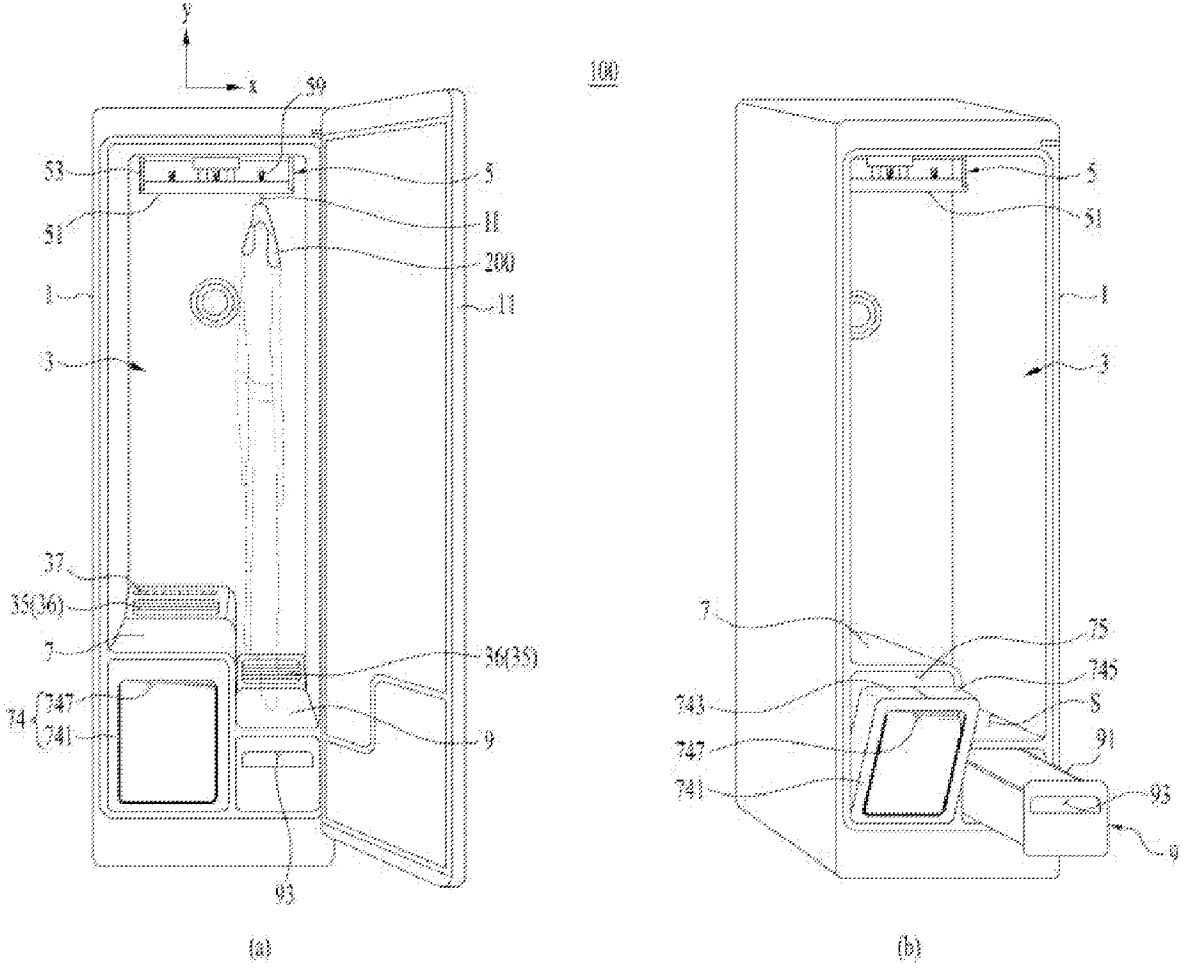
FIG. 1 is a view illustrating a laundry treating apparatus according to an exemplary embodiment of the present invention.

Referring to FIG. 1, a laundry treating apparatus 100 includes a cabinet 1 forming an external appearance of the laundry treating apparatus 100, a laundry accommodation portion 3 provided in the cabinet 1 to provide a space to accommodate the laundry, a laundry supporter 5 provided in the laundry accommodation portion 3 to support the laundry, and a machine chamber 7 provided with at least one of a device (an air supply unit) to supply air (heated air or non-heated air) to the laundry accommodation portion 3 and a device (a moisture supply unit) to supply moisture (water, steam, mist, etc.) to the laundry accommodation portion 3.

The laundry accommodation portion 3 is opened and closed by a door 11 provided to the cabinet 1. Provided in the laundry accommodation portion 3 are a air discharge portion 35 and air suction portion 36 for circulation of air in the laundry accommodation portion 3, and a moisture discharge portion 37 to supply moisture into the laundry accommodation portion 3.

Figure 2:
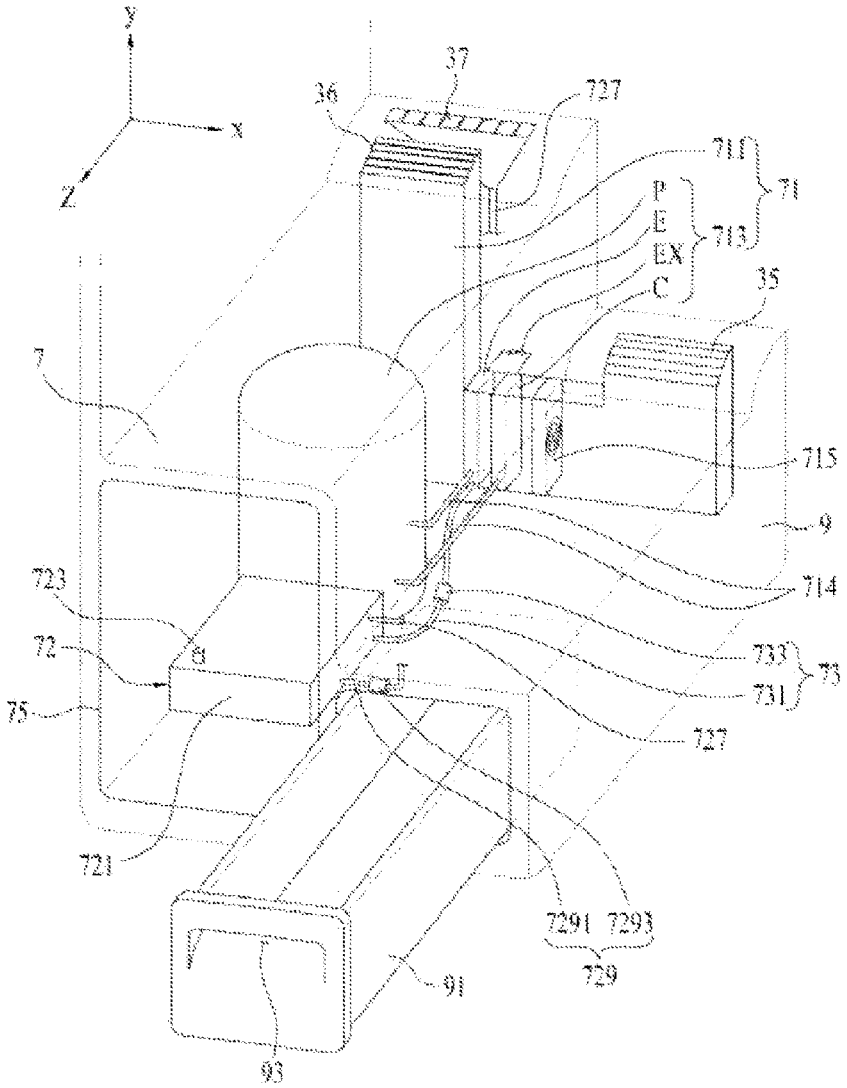
FIG. 2 is a view illustrating a machine chamber and auxiliary the accommodation space provided to the laundry treating apparatus according to one embodiment.

The air discharge portion 35 and the air suction portion 36 are connected to an air supply unit 71 (see FIG. 2) provided the machine chamber 7, and the moisture discharge portion 37 is connected to a moisture supply unit 72 (see FIG. 2).

The machine chamber 7 is separable from the laundry accommodation portion 3 and provides a space to accommodate the air supply unit 71 and the moisture supply unit 72. The machine chamber 7 is provided with an open surface 75 allowing the interior of the machine chamber 7 to communicate with the exterior of the machine chamber 7. The open surface 75 is opened and closed by the machine chamber door 74.

The machine chamber door 74 includes a door body 741 to open and close the open surface 75. The door body 741 is provided with a water supply tank 743 and a drainage tank 745, which are detachably fixed to the door body 741.

The door body 741 may be provided with a handle 747. The door body 741 may be hinged to the open surface 75 to rotate about the lower portion of the open surface 75.

The machine chamber 7 is positioned on the bottom surface of the laundry accommodation portion 3. The width (the length in the x-axis direction in FIG. 2) of the machine chamber 7 is less than the width of the laundry accommodation portion 3.

This is intended to form a space S to accommodate the laundry placed at the laundry supporter 5 between the outer surface of the machine chamber 7 and the inner surface of the laundry accommodation portion 3. Accordingly, the machine chamber 7 is preferably arranged at a corner of the laundry accommodation portion 3 and has a smaller width than that of the laundry accommodation portion 3.

Meanwhile, an auxiliary accommodation portion 9 having a height less than the height (the length in the direction of the y-axis) of the machine chamber 7 may be further provided in the space between the outer surface of the machine chamber 7 and the inner surface of the laundry accommodation portion 3.

The auxiliary accommodation portion 9 provides a storage space where laundry, accessories related to laundry treatment and shoes may be stored. To this end, a drawer 91 and drawer handle 93 withdrawable from the auxiliary accommodation portion 9 may be provided in the auxiliary accommodation portion 9.

In this case, the bottom surface of the laundry accommodation portion 3 is formed by the surface of the machine chamber 7 and the surface of the auxiliary accommodation portion 9, but the height of the auxiliary accommodation portion 9 is less than that of the machine chamber 7. Accordingly, it may be possible for the laundry accommodation portion 3 to accommodate laundry items of different lengths.

As shown in FIG. 2, provided in the machine chamber 7 is at least one of the air supply unit 71 to supply air to the laundry accommodation portion 3 and the moisture supply unit 72 to supply moisture to the laundry accommodation portion 3. Hereinafter, a description will be given of a case in which both the air supply unit 71 and the moisture supply unit 72 are provided.

The air supply unit 71 is a means to supply heated air (hot air) or non-heated air to the laundry accommodation portion 3.

In the case that the air supply unit 71 is configured to supply non-heated air to the accommodation portion 3, the air supply unit 71 may be provided only with a circulation duct 711 and a blower 715.

However, in the case that the air supply unit 71 supplies hot air to the accommodation portion 3, the air supply unit 71 may include a circulation duct 711 providing a flow passage through which air in the accommodation portion 3 circulates, a heat exchange unit 713 to dehumidify and heat air introduced into the circulation duct 711, and a blower 715 provided in the circulation duct 711 to circulate the air in the accommodation portion 3.

One of the air suction portion 36 and the air discharge portion 35 is provided on the upper surface of the machine chamber 7, and the other one of the air suction portion 36 and the air discharge portion 35 is provided on the upper surface of the auxiliary accommodation portion 9.

The height of the auxiliary accommodation portion 9 is less than that of the machine chamber 7. Accordingly, in the case that the air discharge portion 35 (a means to provide air in the circulation duct to the laundry accommodation portion) provided on the auxiliary accommodation portion 9, air may be supplied to the laundry positioned in the space S between the side surface of the machine chamber 7 and the inner surface of the laundry accommodation portion 3.

The air suction portion 36 (a means to introduce air into the circulation duct 711 from the laundry accommodation portion 3) and the air discharge portion 35 are provided at the back of the machine chamber 7 and the back of the auxiliary accommodation portion 9 (i.e., a corner where the rear surface of the laundry accommodation portion 3 meets the upper surface of the machine chamber 7 and a corner where the rear surface of the laundry accommodation portion 3 meets the upper surface of the auxiliary accommodation portion 9).

The air suction portion 36 is positioned adjacent to the air discharge portion 35 to allow the user to easily clean the air suction portion 36 and the air discharge portion 35.

In addition, by positioning the air suction portion 36 and the air discharge portion 35 on the rear surface of the laundry accommodation portion 3 such that they are adjacent to each other, the air supplied to the laundry accommodation portion 3 through the air discharge portion 35 may be prevented from being condensed on the surface of the door 11.

The circulation duct 711 is arranged to penetrate the side surface of the machine chamber 7 to connect the air suction portion 36 to the air discharge portion 35.

Meanwhile, in the case that the heat exchange unit 713 is provided with a heat pump, the heat exchange unit 713 may include an evaporator E provided in the circulation duct 711 to evaporate a refrigerant, a condenser C provided in the circulation duct 711 to condense the refrigerant, a compressor P provided to the exterior of the circulation duct 711 to cause the refrigerant to circulate along the evaporator E and the condenser C through a refrigerant pipe 714, and an expander EX provided in the refrigerant pipe 714.

In this case, the blower 715 is preferably provided between the condenser C and the air discharge portion 35. Thereby, the blower 715 may generate negative pressure generated at the back of the condenser C, facilitating heat exchange between the air in the circulation duct 711 and the evaporator E and the condenser C.

In the case that the blower 715 is positioned between the air suction portion 36 and the evaporator E, the blower 715 generates positive pressure between the air suction portion 36 and the evaporator E to supply air to the evaporator E.

The positive pressure formed between the air suction portion 36 and the evaporator E may cause non-constant flow rate per unit area depending upon the shape of the circulation duct 711. On the other hand, the negative pressure formed between the condenser C and the air discharge portion 35 may maintain a relatively constant flow rate per unit area of the circulation duct (i.e. heat exchange efficiency of air may be improved). Therefore, the blower 715 is preferably provided between the condenser C and the air discharge portion 35.

Preferably, the evaporator E, the condenser C and the blower 715 are provided to the circulation duct 711 positioned in the machine chamber 7. This is intended to facilitate maintenance of the heat exchange unit 713.

That is, providing a machine chamber rear door (not shown) on the rear surface of the machine chamber 7 and providing a duct door (not shown) allowing access to the heat exchange unit 713 to the circulation duct 711 may be beneficial for repair and replacement of the heat exchange unit 713.

The evaporator E and the condenser C provided in the circulation duct 711 are connected to the compressor P through the refrigerant pipe 714, and the refrigerant is circulated along the evaporator E and the condenser C by the refrigerant pipe 714 and the compressor P.

The compressor P, which is provided to the exterior of the circulation duct 711, occupies the largest volume among the components constructing the heat exchange unit 713. Therefore, the machine chamber 7 preferably has a minimum volume capable of accommodating the compressor P.

Even when the machine chamber 7 has minimum width and height allowing the compressor P to be accommodated therein, the length (in the z-axis direction in FIG. 2) of the machine chamber 7 is greater than the diameter of the compressor P. Therefore, other devices (such as the moisture supply unit) having a smaller volume than the compressor P may be disposed around the compressor P in the inner space of the machine chamber 7.

Accordingly, the laundry treating apparatus 100 of the illustrated embodiment may allow the width and height of the machine chamber 7 to be minimized, and minimization of the height and width of the machine chamber 7 may secure a space S capable of accommodating the laundry between the side surface of the machine chamber 7 and the inner space of the laundry accommodation portion 3. Therefore, the amount of laundry accommodated in the laundry accommodation portion 3 having a certain volume may be maximized, and a long laundry item may be accommodated in the laundry accommodation portion 3 having a limited volume.

The moisture supply unit 72 is a means to supply steam or mist to the accommodation space. Hereinafter, an example of the moisture supply unit 72 configured to supply steam will be described.

The moisture supply unit 72 may include a storage unit 721 positioned in front of the compressor P and configured to store water, a heater 725 (see FIG. 3) to heat water stored in the storage unit 721, and a moisture supply pipe 727 to move steam generated in the storage unit 721 to the moisture discharge portion 37.

The moisture discharge portion 37, which is provided on the upper surface of the machine chamber 7, is a means to supply moisture (steam) to the accommodation portion 3. Preferably, the moisture discharge portion 37 is provided to the rear surface of the machine chamber 7 (i.e., the corner where the upper surface of the machine chamber 7 meets the rear wall surface of the accommodation portion 3).

This is intended to prevent the steam from condensing on the surface of the door 11.

Unlike the embodiment illustrated in FIG. 2, the moisture discharge portion 37 may be provided on the upper surface of the auxiliary accommodation portion 9.

The storage unit 721 may include a water supply portion 723 coupled to the water supply tank 743 provided to the machine chamber door 74 to allow water to be introduced into the storage unit 721, and a residual water discharge portion 729 allowing the water stored in the storage unit 721 to be discharged to the drainage tank 745.

The water supply portion 723 may be provided with a pipe connecting the storage unit 721 to the water supply tank 743, and the residual water discharge portion 729 may be provided with a residual water discharge pipe 7291 connecting the storage unit 721 to the drainage tank 745, which will be described later, and a pump 7293 provided to the residual water discharge pipe 7291.

Figure 3:
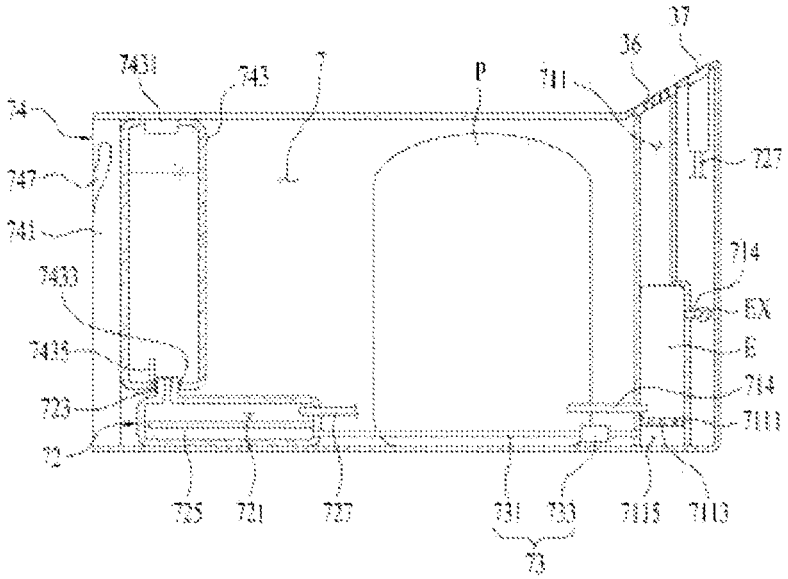
FIG. 3 is a view illustrating the internal structure of the machine chamber.
Figure 3:
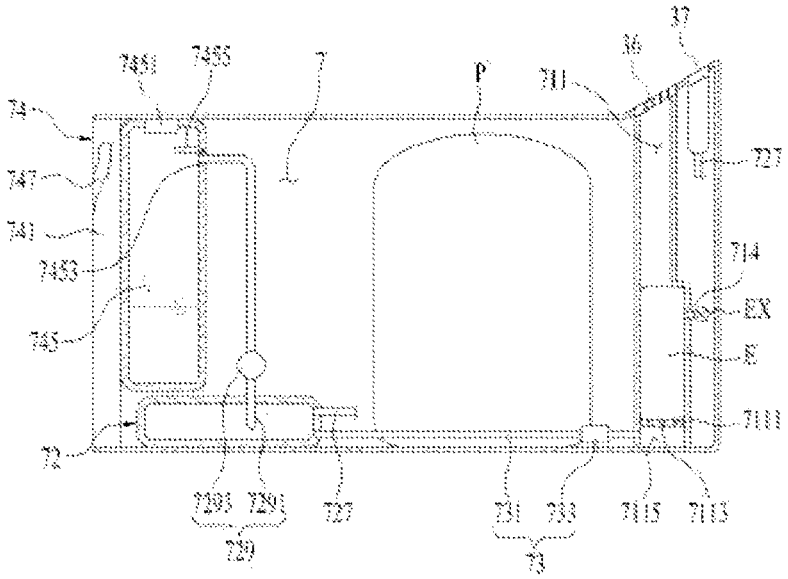

As shown in FIG. 3, the water supply tank 743 serves to store water to be supplied to the storage unit 721 of the moisture supply unit 72 and may include a water supply tank lid 7431, a drainage port 7433 and a check valve 7435.

The water supply tank lid 7431 is detachably provided to an upper portion of the machine chamber door 74, and the user may supply water to the machine chamber door 74 through the water supply tank lid 7431.

The drainage port 7433 is provided to the bottom surface of the water supply tank 743 to discharge water from the water supply tank 743. The check valve 7435 is provided to the drainage port 7433.

Accordingly, when the machine chamber door 74 is closed, the water supply portion 723 is inserted into the drainage port 7433. As the water supply portion 723 is inserted into the drainage port 7433, the check valve 7435 rotates toward the interior of the water supply tank 743, opening the drainage port 7433. Thereby, water may move from the water supply tank 743 to the storage unit 721 of the moisture supply unit 72.

The drainage tank 745 serves to collect the water remaining in the storage unit 721 through the residual water discharge portion 729. The drainage tank 745 is detachably provided to the door body 741.

The drainage tank 745 may include a drainage tank lid 7451 to discharge water stored in the drainage tank 745, an introduction port 7453 into which the residual water discharge pipe 7291 is inserted, and a check valve 7455 provided to the introduction port 7453.

The introduction port 7453 is provided to the upper portion of the drainage tank 745 (i.e., is positioned at a certain height from the bottom surface of the drainage tank 745). When the door body 741 closes the open surface 75 of the machine chamber 7, the residual water discharge pipe 7291 is inserted into the introduction port 7453. As the residual water discharge pipe 7291 is inserted into the introduction port 7453, the check valve 7455 rotates toward the interior of the drainage tank 745, opening the introduction port 7453.

Accordingly, the residual water discharge portion 729 may move the water remaining in the storage unit 721 to the drainage tank 745.

The machine chamber 7 may further include a condensed water collecting portion 73 to move condensed water produced in the evaporator E to the drainage tank 745.

The condensed water collecting portion 73 may directly connect the circulation duct 711 to the drainage tank 745. Alternatively, the condensed water collecting portion 73 may include a pump 733 connecting the circulation duct 711 to the storage unit 721 and a pump 733 provided to the collecting pipe 731, as shown in FIG. 3.

In this case, a condensed water storage unit is provided in the circulation duct 711. The condensed water storage may include a support plate 7111 supporting the evaporator E, a through hole 7113 penetrating the support plate 7111, and a sump 7115 positioned under the support plate 7111 to store condensed water and connected to the collecting pipe 731.

Accordingly, a control unit (not shown) may not only control the pump 7293 to discharge water remaining in the moisture supply unit 72 to the drainage tank 745, but also control the pump 733 and pump 7293 to discharge the condensed water produced in the evaporator E to the drainage tank 745.

The laundry supporter 5 according to the illustrated embodiment shakes a hanger 200 (see FIG. 1) with laundry placed thereon in the laundry accommodation portion 3. By moving the hanger 200 with laundry placed thereon, the laundry supporter 5 may shorten the laundry treatment time, reduce power consumption for laundry treatment, and effectively remove wrinkles from the laundry.

Particularly, the laundry supporter 5 moves the hanger 200 such that the hanger 200 reciprocates with the free end thereof forming an arc trajectory in the laundry accommodation portion 3, rather than rectilinearly reciprocating in the width direction (the x-axis direction) of the laundry accommodation portion 3.

Figure 4:
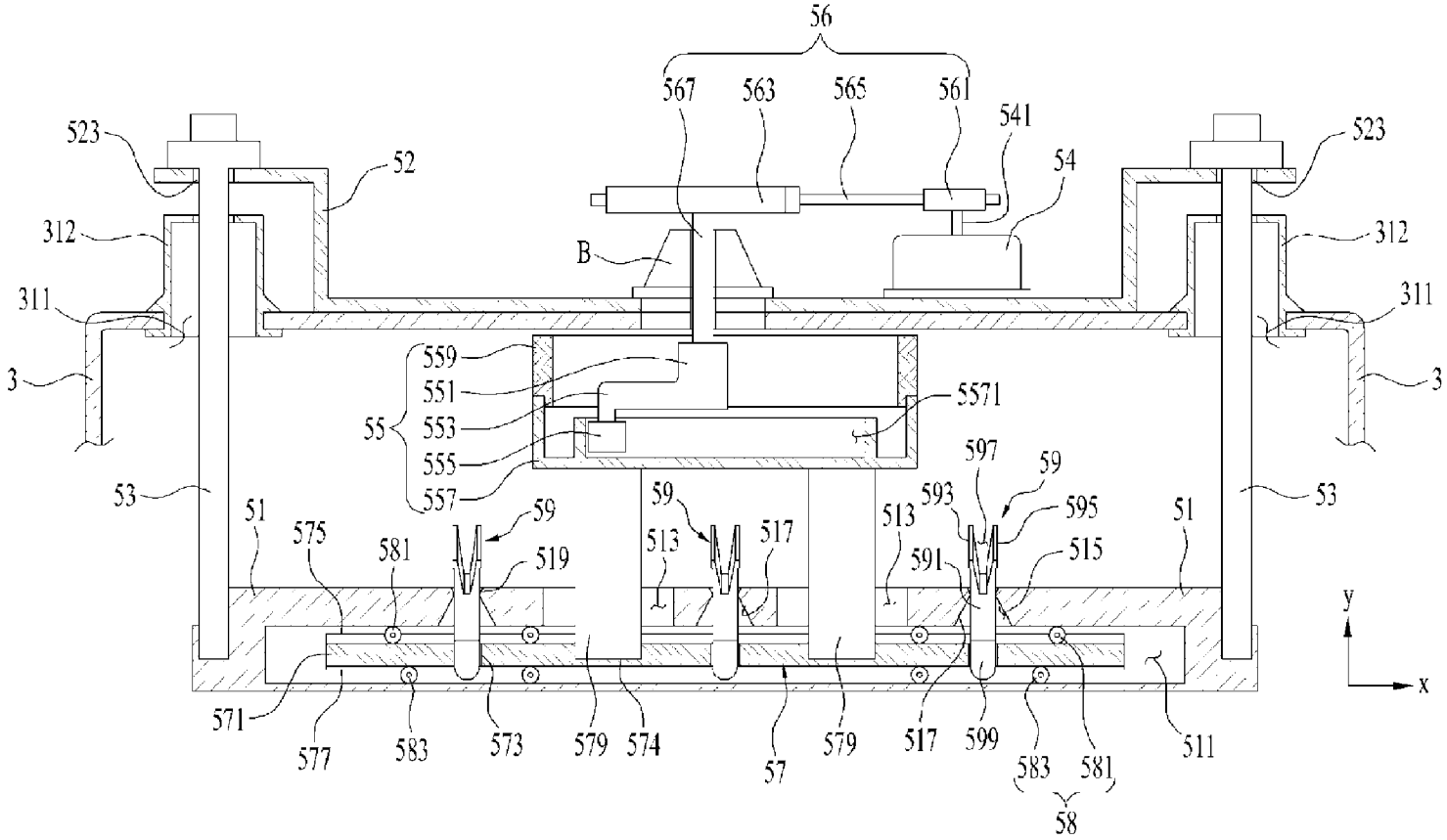
FIGS. 4 and 5 are views illustrating a laundry supporter provided to the laundry treating apparatus according to one embodiment.
Figure 5:
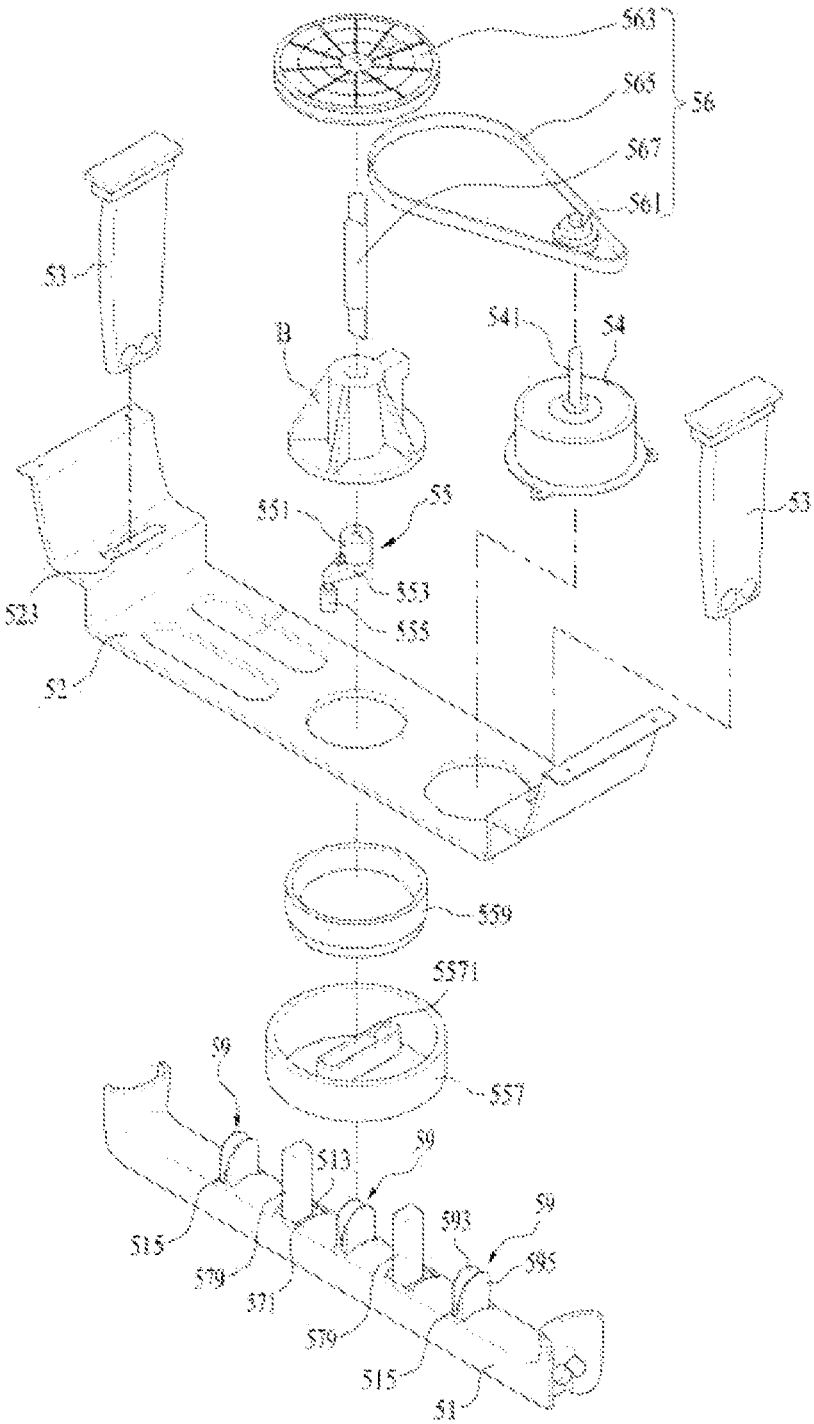

As shown in FIGS. 4 and 5, the laundry supporter 5 includes an adapter 59 to which a hook H (see FIG. 1) of the hanger is detachably fixed, support parts 51 and 53 to support the adapter 59, and a drive unit 57 to move the adapter 59 such that the adapter 59 reciprocates within a predetermined angular range forming an arc trajectory.

The support parts 51 and 53 may include a housing 51 provided therein with an accommodation space 511 and a housing support bar 53 connecting the housing 51 to the laundry accommodation portion 3.

The housing support bar 53 fixes both ends of the housing 51 to the upper surface of the laundry accommodation portion 3 such that the housing 51 is arranged in the width direction (the x-axis direction) of the laundry accommodation portion 3. Preferably, the housing support bar 53 is formed of a material such as rubber that is capable of absorbing vibration of the housing 51.

The housing 51 is provided with an adapter insertion hole 515 that allows the accommodation space 511 to communicate with the exterior of the housing 51. The adapter 59 is accommodated in the adapter insertion hole 515.

The drive unit may include a driving bar 57 positioned in the accommodation space 511 and connected with one end of the adapter 59. The driving bar 57 may include a driving bar body 571 provided with a length less than that of the accommodation space 511 to reciprocate within the accommodation space 511, and an adapter accommodation hole 573 provided to the driving bar body 571 such that the adapter 59 is connected thereto.

The driving bar body 571 is supported by a driving bar supporter 58 which is rotatably provided in the accommodation space 511 of the housing 51. The driving bar supporter 58 may include an upper roller 581 to support the upper surface of the driving bar body 571 and a lower roller 583 to support the lower surface of the driving bar body 571.

In this case, the driving bar 57 may further include two upper guiders 575 (see FIG. 7) provided to opposite ends of the upper surface of the driving bar body 571 facing each other in the longitudinal direction of the driving bar body 571 and two lower guiders 577 (see FIG. 7) provided to opposite ends of the lower surface of the driving bar body 571 facing each other.

The upper roller 581 is positioned in the space defined by the upper guiders 575 to support the upper surface of the driving bar body 571, and the lower roller 583 is positioned in the space defined by the lower guiders 577 to support the lower surface of the adapter accommodation hole 573.

Accordingly, the driving bar body 571 is prevented from escaping the reciprocation orbit set by the driving bar supporter 58 and the guiders 575 and 577.

The adapter 59 includes an adapter body 591 positioned in the adapter insertion hole 515 of the housing 51 and a body connection bar 599 connecting the adapter body 591 with the driving bar body 571 and inserted into the adapter accommodation hole 573.

The adapter body 591 is provided with an accommodation groove 597 configured to detachably accommodate the hook H of the hanger 200 and positioned over the adapter insertion hole 515.

The accommodation groove 597 maybe formed by a pair of flanges 593 and 595 extending from the adapter body 591 outward of the adapter insertion hole 515 and spaced a predetermined distance in the x-direction from each other.

In the case that the body connection bar 599 is inserted into the adapter accommodation hole 573 and thus coupled to the driving bar 57, the body connection bar 599 may be formed of an elastic material. The body connection bar 599 and the driving bar body 571 may be coupled through a different element than the adapter accommodation hole 573.

That is, the body connection bar 599 may be rotatably coupled to an axle provided to the driving bar body 571. In this case, the adapter accommodation hole 573 may be omitted.

When the driving bar 57 reciprocates within the accommodation space 511, the adapter 59 is supported in the adapter insertion hole 515 to reciprocate forming an arc trajectory within a predetermined angular range. To facilitate reciprocation of the adapter 59, the housing 51 may be provided with at least one of an adapter support surface 519 and an inclined surface 517.

The adapter support surface 519 is a surface of the housing 51 that is inclined down at a predetermined angle toward the adapter insertion hole 515. The adapter support surface 519 is provided to the adapter insertion hole 515 to support both ends of the adapter body 591 facing each other.

The inclined surface 517 is a surface of the accommodation space 511 that is inclined up toward the adapter insertion hole 515 to set the range of reciprocation of the adapter 59.

The inclined surface 517 and the adapter support surface 519 may be connected to each other, as shown in FIG. 4. In this case, friction between the surface of the adapter 59 and the adapter insertion hole 515 may be minimized, and thus the adapter 59 may more easily reciprocate forming an arc trajectory.

Meanwhile, the driving bar 57 is caused to reciprocate in the accommodation space 511 by a power supply unit. The driving bar 57 may be caused to reciprocate in the accommodation space 511 by a power supply unit provided in the accommodation space 511, or by a power supply unit outside the accommodation space 511.

In the case that the power supply unit is provided in the accommodation space 511, the power supply unit may include a magnetic member (not show) provided to the driving bar body 571 and an electromagnet alternately applying attractive force and repulsive force to the magnetic member.

In addition, the power supply unit may include a rack (not shown) provided to the driving bar body 571, a pinion (not show) rotatably provided in the accommodation space 511 to be coupled to the rack, and a motor (which may be provided outside the accommodation space) configured to rotate the pinion.

FIGS. 4 and 5 illustrate an embodiment in which the power supply unit is provided outside the accommodation space 511.

The power supply unit shown in FIGS. 4 and 5 may include a motor 54 positioned outside the laundry accommodation portion 3, a power conversion unit 55 configured to convert motion of a rotation shaft 541 provided to the motor 54 into rectilinear reciprocation to rectilinearly reciprocate the driving bar 57, and a power transmission unit 56 configured to transfer the power supplied from the motor 54 to the power transmission unit 56.

The motor 54 is fixed to a support frame 52 provided outside (for example on top of) the laundry accommodation portion 3. The support frame 52 is provided with a support bar fixing hole 523 to which the housing support bar 53 is fixed.

Accordingly, one end of the housing support bar 53 is fixed to the support bar fixing hole 523, and the other end of the housing support bar 53 is positioned in the laundry accommodation portion 3 through an accommodation portion through hole 311 provided in the upper surface of the laundry accommodation portion 3.

The accommodation portion through hole 311 may be provided with a sealing member 312 to prevent moisture or air supplied into the laundry accommodation portion 3 from being discharged from the accommodation space through the accommodation portion through hole 311.

The power transmission unit 56 may include a drive pulley 561 coupled to the rotation shaft 541, a driven pulley 563 connected to the drive pulley 561 through a belt 565 or a chain, and a transmission shaft 567 coupled to the center of the driven pulley 563.

The transmission shaft 567 is rotatably supported by a bearing housing B fixed to the support frame 52.

The power conversion unit 55 may include a shaft coupling portion 551 coupled to the transmission shaft 567, a rotating arm 553 extending from the shaft coupling portion 551 in a direction perpendicular to the transmission shaft 567, a slot insertion portion 555 provided to one end of the rotating arm 553 to rotate about the transmission shaft 567, a slot housing 557 connected with the driving bar 57, and a slot 5571 provided to the slot housing 557 to accommodate the slot insertion portion 555.

In this case, the housing 51 is preferably provided with a connection bar through hole 513 allowing the accommodation space 511 to communicate with the exterior of the housing 51, and the driving bar 57 is preferably provided with a connection bar 579 positioned in the connection bar through hole 513 to connect the slot housing 557 to the driving bar body 571. The lower end of the connection bar 579 is inserted into a recess 574 of the driving bar body 571.

The length of the connection bar through hole 513 formed in the longitudinal direction of the housing 51 should be greater than the width of the connection bar 579 formed in the longitudinal direction of the driving bar 57. The driving bar body 571 may reciprocate in the accommodation space 511 by the difference between the length of the connection bar through hole 513 and the width of the connection bar 579.

In addition, a conversion unit cover 559 preventing exposure of the power conversion unit 55 may be provided to the upper portion of the slot housing 557 (the portion between the slot housing and the upper surface of the laundry accommodation portion).

In the laundry supporter 5 configured as above, the driven pulley 563 is rotated by the motor 54, and accordingly the transmission shaft 567 coupled to the driven pulley 563 is also rotated. Accordingly, the slot insertion portion 555 moves in a circle centered at the shaft coupling portion 551 with a radius corresponding to the length of the rotating arm 553.

Figure 6:
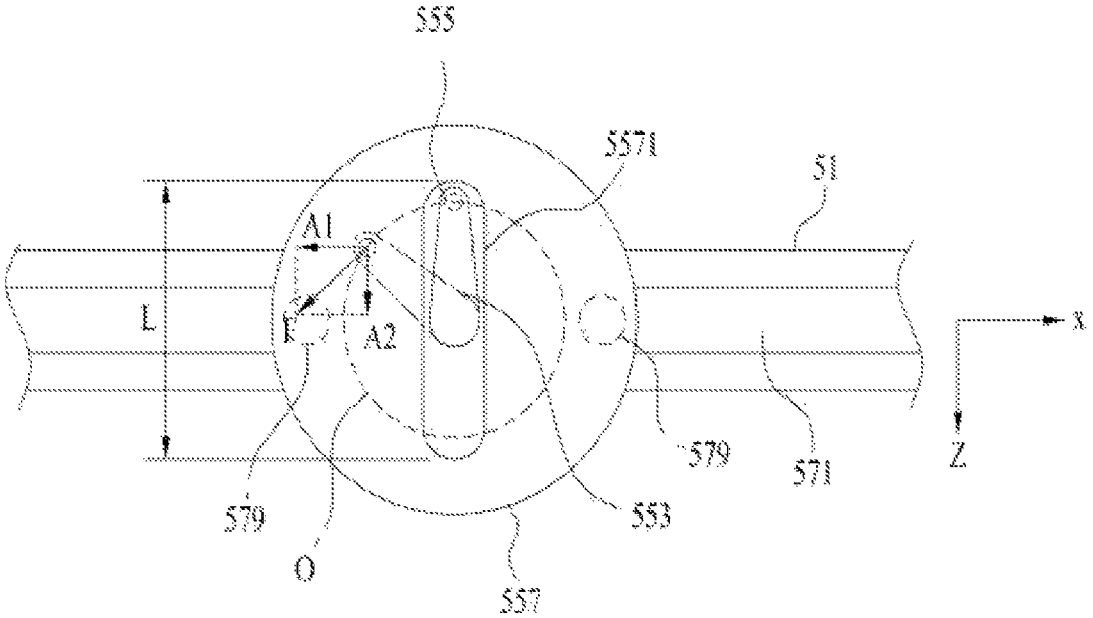
FIG. 6 is a view illustrating operation of the laundry supporter.

As shown in FIG. 6, the slot 5571 may be arranged perpendicular to the longitudinal direction of the driving bar body 571, and the length L thereof may be greater or equal to the diameter of the rotation trajectory O of the slot insertion portion 555.

In this case, when the slot insertion portion 555 rotates, the slot 5571 reciprocates along the x-axis. Accordingly, the driving bar body 571 connected to the slot 5571 through the connection bar 579 and the slot housing 557 will reciprocate in the accommodation space 511.

That is, the slot insertion portion 555 of the power conversion unit 55 is rotated along the rotation trajectory O by the rotary power provided by the motor 54, the slot 5571 is moved by a force component A1 parallel to the driving bar body 571 of the force F provided by the slot insertion portion 555. Accordingly, the driving bar body 571 reciprocates along the x-axis.

In the laundry supporter 5 described above, the driving bar body 571 receives the power of the motor 54 through the power transmission unit 56. However, the driving bar body 571 may directly receive the power of the motor 54. In this case, the shaft coupling portion 551 of the power conversion unit 55 may be directly coupled to the rotation shaft 541.

Further, it may be possible that the power transmission unit 56 transfers the power of the motor 54 to the power conversion unit 55 through a drive gear coupled to the rotation shaft 541 and a driven gear fixed to the transmission shaft 567 and coupled to the drive gear.

Figure 8:
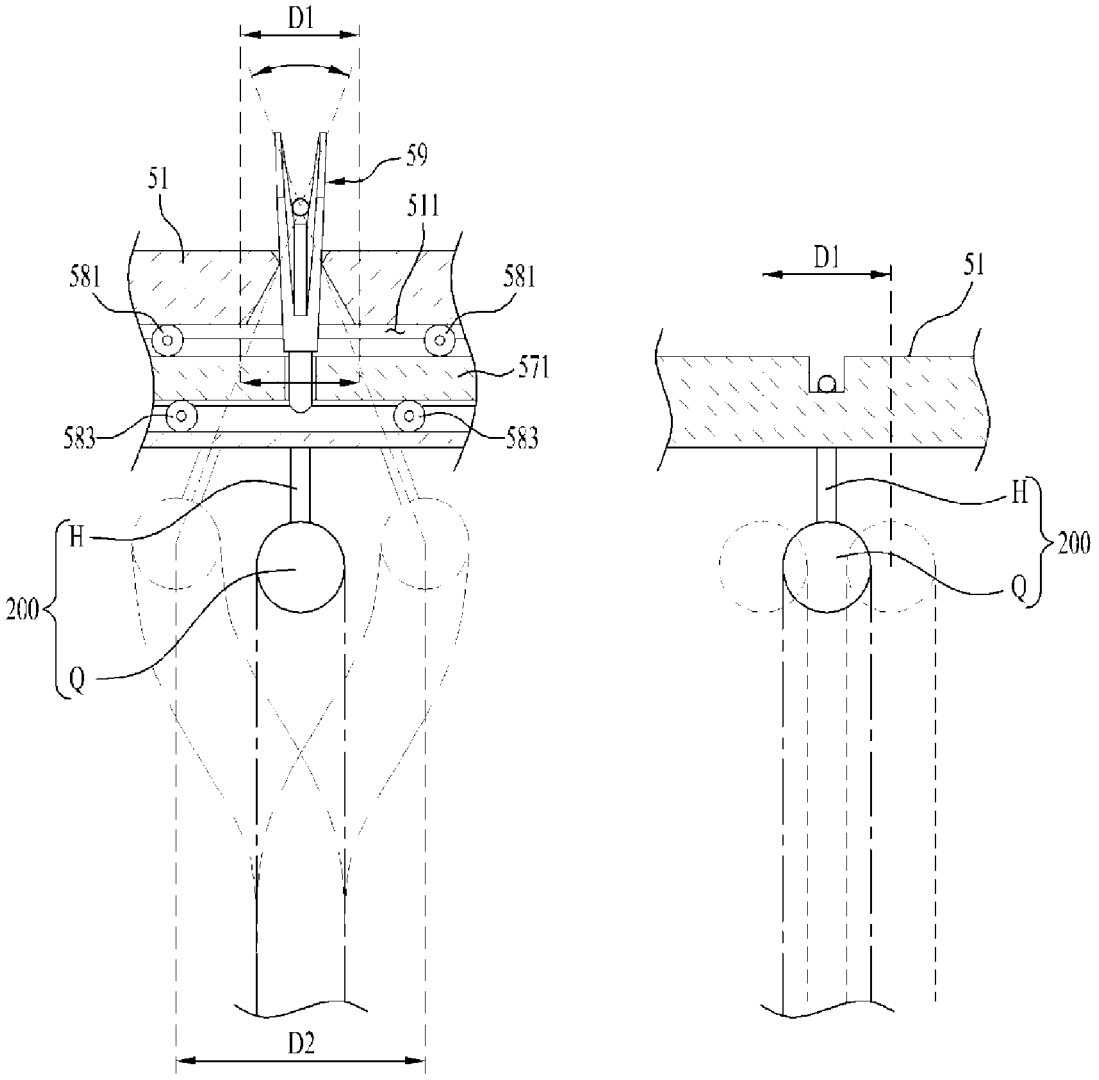
FIG. 8 is a view illustrating movement of the adapter and a hanger accommodated in the adapter.

When the driving bar body 571 reciprocates in the accommodation space 511, the adapter 59 supported by the adapter insertion hole 515 of the housing 51 and the free end Q of the hanger 200 supported by the accommodation groove 597 of the adapter 59 reciprocate forming an arc trajectory shown in FIG. 8(*a*).

That is, when the adapter 59 reciprocates and forms an arc trajectory, the free end Q of the hanger 200 connected to the adapter 59 through the hook H of the hanger 200 also reciprocates forming an arc trajectory.

In the embodiment illustrated in FIG. 8(*b*), the hanger 200 is supported by the housing 51 rectilinearly reciprocating in the width direction of the laundry accommodation portion 3 (i.e., the adapter 59 and the driving bar 57 are not provided to the laundry supporter). In the structure illustrated in FIG. 8(*b*), the hanger 200 may move by a distance D1 corresponding to the diameter of the rotation trajectory formed by the slot insertion portion 555. In addition, in the structure illustrated in FIG. 8(*b*), the laundry reciprocates in the laundry accommodation portion 3, while rarely shaking in the height direction of the laundry accommodation portion 3.

On the other hand, in the case that the adapter 59 and the driving bar 57 are provided to the laundry supporter 5 as shown in FIG. 8(*a*), the hanger 200 placed on the laundry supporter 5 may make a larger movement D2 than in the case shown in FIG. 8(*b*).

When the driving bar body 571 reciprocates by a distance D1 corresponding to the diameter of the rotation trajectory O formed by the slot insertion portion 555, the free end Q of the hanger 200 forms an arc trajectory centered at the accommodation groove 597 of the adapter 59 with a radius equal to the length of the hook H of the hanger 200. Accordingly, the hanger 200 may move within a distance D2 greater than the diameter D1 of the rotation trajectory O formed by the slot insertion portion 555.

In addition, when the hanger 200 reciprocates forming an arc trajectory, the laundry moves similar to a sine wave when viewed in the height direction of the laundry accommodation portion 3. Accordingly, the laundry treating apparatus 100 allows the laundry to make various kinds of movement. Thereby, laundry treatment efficiency may be increased.

Figure 7:
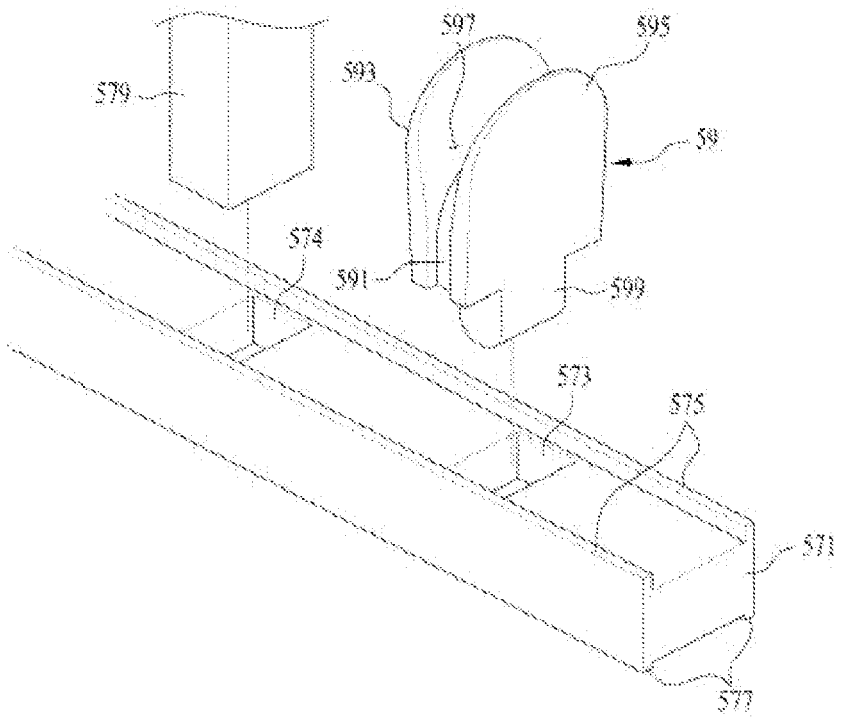
FIG. 7 is a view illustrating a driving bar and adapter provided to the laundry supporter.
Figure 7:
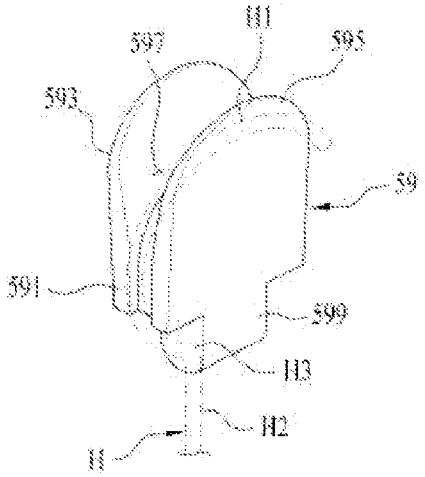

In the case that a first flange 593 and a second flange 595 provided to the adapter 59 are arranged to support a detachable attachment portion H1 (a portion supported by the adapter), which is provided to the hook H of the hanger 200 to prevent rotation of the hook H in the accommodation groove 597 during movement of the adapter 59, or a connection portion H3 connecting the detachable attachment portion H1 and the extension portion H2 (i.e., a portion connecting the hook to the hanger), the hanger 200 may accurately perform the aforementioned movement (see FIG. 7).

As is apparent from the above description, the present invention has effects as follows.

A laundry treating apparatus according to one embodiment of the present invention may facilitate drying, deodorization, wrinkle removal and sanitization of laundry.

In addition, a laundry treating apparatus according to one embodiment of the present invention may prevent damage to the laundry and reduce power consumption.

In addition, a laundry treating apparatus according to one embodiment of the present invention may provide an accommodation space to accommodate laundry items of different lengths.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry treating apparatus comprising:

a cabinet that forms an external appearance of the laundry treating apparatus;

a laundry accommodation portion arranged in the cabinet that provides a space to accommodate laundry;

a machine chamber including at least one of an air supply unit to supply air to the laundry accommodation portion and a moisture supply unit to supply moisture to the laundry accommodation portion, the machine chamber being provided separately from the laundry accommodation portion; and a laundry supporter to support a hanger having laundry placed thereon and to move the hanger such that a free end of the hanger forms an arc trajectory in the laundry accommodation portion, wherein the laundry supporter includes:

an adapter to allow the hanger to be detachably mounted thereto;

a support part positioned in the laundry accommodation portion to support the adapter; and a drive unit to move the adapter such that the adapter reciprocates within a predetermined angular range and forms an arc trajectory, wherein the support part includes a housing having an accommodation space therein; a housing support bar that connects the housing to the laundry supporter; and an adapter insertion hole that allows the accommodation space to communicate with an exterior of the housing and that allows the adapter to be inserted thereinto, wherein the drive unit includes a driving bar configured to reciprocate within the accommodation space and connected to an end of the adapter, and wherein the adapter includes an accommodation groove positioned over the adapter insertion hole that allows a hook provided to the hanger to be detachably accommodated therein.

2. The laundry treating apparatus according to claim 1, wherein the support part further includes an adapter support surface inclined from a surface of the housing toward the adapter insertion hole to support a surface of the adapter.

3. The laundry treating apparatus according to claim 2, wherein the support part further includes an inclined surface inclined from a surface of the accommodation space toward the adapter insertion hole to limit a range of reciprocation of the adapter.

4. The laundry treating apparatus according to claim 1, wherein the drive unit further includes a driving bar supporter rotatably provided in the accommodation space to support the driving bar.

5. The laundry treating apparatus according to claim 4, wherein the driving bar includes:

a driving bar body formed in a bar shape to reciprocate in the accommodation space; and a lower guider arranged in a longitudinal direction of the driving bar body and provided at opposite ends of a lower surface of the driving bar body facing each other, wherein the driving bar supporter includes a lower roller positioned in a space formed by the lower guider that contacts the driving bar body.

6. The laundry treating apparatus according to claim 5, wherein the driving bar includes an upper guider arranged in the longitudinal direction of the driving bar body and provided at opposite ends of an upper surface of the driving bar body facing each other, wherein the driving bar supporter includes an upper roller positioned in a space formed by the upper guider that contacts the driving bar body.

7. The laundry treating apparatus according to claim 1, wherein the drive unit further includes a power supply unit to provide power such that the driving bar to reciprocates in the accommodation space.

8. The laundry treating apparatus according to claim 7, wherein the power supply unit includes a motor provided with a rotation shaft and fixed to an exterior of the laundry accommodation portion; and a power conversion unit to convert rotation of the rotation shaft into rectilinear reciprocation, wherein:

the support part further includes a connection bar through hole that penetrates the housing to allow the accommodation space to communicate with the exterior of the housing; and the drive unit further includes a connection bar that connects the power conversion unit to the driving bar through the connection bar through hole.

9. The laundry treating apparatus according to claim 8, wherein a length of the connection bar through hole formed in a longitudinal direction of the housing is greater than a width of the connection bar formed in a longitudinal direction of the driving bar.

10. The laundry treating apparatus according to claim 9, wherein the power conversion unit comprises:

a slot housing positioned in the laundry accommodation portion and arranged in a plane parallel with a plane having the accommodation space positioned, the connection bar being fixed to the slot housing;

a slot provided to the slot housing;

a rotating arm rotated by the motor; and a slot insertion portion extending from the rotating arm and inserted into the slot, wherein a length of the slot is greater than or equal to a diameter of an rotation trajectory formed by the slot insertion portion.

11. The laundry treating apparatus according to claim 10, wherein the power supply unit further includes a power transmission unit to transfer rotary power of the rotation shaft to the rotating arm, wherein:

the power transmission unit includes a transmission shaft arranged to penetrate the laundry accommodation portion; a driven pulley provided to the transmission shaft, a drive pulley provided to the rotation shaft; and a belt to connect the drive pulley to the driven pulley, and the power conversion unit further includes a shaft coupling portion to connect the transmission shaft to the rotating arm.

12. The laundry treating apparatus according to claim 1, wherein the machine chamber is provided with a width smaller than a width of the laundry accommodation portion such that the space to accommodate the laundry placed on the laundry supporter is formed between an outer surface of the machine chamber and an inner surface of the laundry accommodation portion.

13. The laundry treating apparatus according to claim 12, further including an auxiliary accommodation portion provided in the space between the outer surface of the machine chamber and the inner surface of the laundry accommodation portion to provide a storage space, wherein a height of the auxiliary accommodation portion is lower than a height of the machine chamber.

14. A laundry treating apparatus comprising:

a cabinet including a laundry accommodation space to accommodate laundry;

a machine chamber separated from the laundry accommodation space, the machine chamber including at least one of an air supply device to supply air to the laundry accommodation space and a moisture supply device to supply moisture to the laundry accommodation space; and a laundry supporter to support at least one hanger and to move the hanger in the laundry accommodation space, wherein the laundry supporter includes:

a support bar having a plurality of openings, a plurality of adapters provided in the plurality of openings, the adapters configured to accommodate an end of the hanger and to pivot toward a first direction and a second direction, a support bar driver configured to move the support bar in the first and second directions, wherein when the support bar is moved in the first direction, the adapters pivot toward the second direction, and when the support bar is moved in the second direction, the adapters pivot toward the first direction.

15. The laundry treating apparatus according to claim 14, wherein the support bar driver moves the adapters to pivot in the first and second directions such that ends of the adapters form an arc at a predetermined angular range.

16. The laundry treatment apparatus according to claim 14, wherein the laundry supporter further includes a housing that accommodates the support bar, the adapters, and the support bar driver therein.

* * * * *